US005939718A

United States Patent [19]

Yamada et al.

[11] Patent Number: 5,939,718

[45] Date of Patent: Aug. 17, 1999

[54] INDUCTIVELY COUPLED PLASMA MASS SPECTROSCOPIC APPARATUS

[75] Inventors: Noriyuki Yamada; Kenichi Sakata; Shigeru Nawa, all of Tokyo, Japan

[73] Assignee: Hewlett-Packard Company, Palo Alto, Calif.

[21] Appl. No.: 08/901,503

[22] Filed: Jul. 28, 1997

[30] Foreign Application Priority Data

Jul. 30, 1996 [JP] Japan ..... 8-200254
Oct. 7, 1996 [JP] Japan ..... 8-266135

[51] Int. Cl.[6] ..... H01J 49/10

[52] U.S. Cl. ..... 250/288; 250/292

[58] Field of Search ..... 250/288, 291, 250/292, 294, 296

[56] References Cited

U.S. PATENT DOCUMENTS

| | | | |
|---|---|---|---|
| 3,410,997 | 11/1968 | Brubaker | 250/292 |
| 4,682,026 | 7/1987 | Douglas | 250/288 |
| 5,389,785 | 2/1995 | Steiner et al. | 250/292 |
| 5,576,540 | 11/1996 | Jolliffe | 250/292 |
| 5,616,919 | 4/1997 | Broadbent et al. | 250/292 |
| 5,767,512 | 6/1998 | Eiden et al. | 250/288 |

FOREIGN PATENT DOCUMENTS 62-26757 7/1985 Japan .

OTHER PUBLICATIONS

Hewlett–Packard Product Catalog entitled: Th HP–4500 ICP–MS. No Date.

Article entitled Space Charge in ICP–MS: Calculation and Implication by Scott D. Tanner, Spectrochimica Acta., vol. 47B (1992), pp. 809–923.

Articled entitled New Ion–Optical Devices Utilizing Oscillatory Electric Fields. III. Stability of Ion Motion in a Two–Dimensional Octopole Field by Conny Hagg and Imre Szabo, International Journal of Mass Spectrometry and Ion Processes, 73 (1986), pp. 277–294.

Article entitled New Ion–Optical Devices Utilizing Oscillatory Electric Field IV. Computer Simulations of the Transport of an Ion Beam Through an Ideal Quadrupole, Hexapole, and Octopole Operating in the RF–Only Mode by Conny Hagg and Imre Szabo, International Journal of Mass Spectrometry and Ion Processes, 73 (1986), pp. 295–312.

Article entitled Langmuir Probe Measurements of Electron Temperature and Electron Density Behind the Skimmer of an Inductively Coupled Plasma Mass Spectrometer by H.S. Niu et al., Spectrochimica Acta, vol. 46B (1991), pp. 805–817.

Article entitled Ion Transport Through a Strong Magnetic Field Gradient by R.F.–Only Octopole Ion Guides by Yulin Huang et al., International journal of Mass Spectrometry and Ion Processes 152 (1996), pp. 121–133.

*Primary Examiner*—Kiet T. Nguyen

[57] ABSTRACT

An inductively coupled plasma mass spectroscopic includes a sample introduction section for nebulizing a sample solution; an ionization section, including a torch, for ionizing a nebula of a sample solution that is carried with a carrier gas; an interface section for sampling the ionized elements in the nebula at an atmospheric pressure and directing ions of the ionized elements into an ion lens section under a vacuum; the ion lens portion, containing an ion beam guide, for converging the ions which have passed through the interface section wherein at least one part of the ion lens portion is a multipole ion beam guide with at least four electrode rods; a mass selection portion, having a mass filter, for filtering the ions based on the measured mass number; and a detection section for counting filtered ions.

23 Claims, 11 Drawing Sheets

INDUCTIVELY COUPLED PLASMA MASS SPECTROSCOPIC APPARATUS

FIELD OF THE INVENTION

The present invention relates to an inductively coupled plasma mass spectroscopic apparatus and, more particularly, to an inductively coupled plasma mass spectroscopic apparatus that employs an ion beam guide that are easily adjusted and highly efficient at transmitting ions to its mass spectrometer.

BACKGROUND OF THE INVENTION

There have been recent proposals, such as Japanese patent laid-open publication number 62(1987)-26757, for an inductively coupled plasma mass spectroscopic apparatus that utilizes ions to perform an element analysis in a solution.

Referring to FIG. 1, such inductively coupled plasma mass spectroscopic apparatus includes a sample introduction section 10, a gas control section 18, an ionization section 20, RF power supply 26, an interface section 30, ion lens section 40, a mass selection section 50, a mass filter drive circuit 56 and an ion detection section 60.

The sample introduction section 10 nublizes a solution containing sample components to be analyzed, i.e. a sample solution and introduces a sample solution into an ionization section 20. The sample introduction section 10 further includes a peristaltic pump 12 that continuously brings sample solution 8 into a spray chamber 16, and at the same time, pumps exhaust liquid out of the spray chamber, and a nebulizer 14 which nebulizes sample solution 8 that has been sampled by peristaltic pump 12, and spray chamber 16 which separates finer droplets from the nebulized droplets (neublized by nebulizer 14).

The gas control section 18 injects a carrier gas (e.g. Ar gas) into a nebulizer 14.

The ionization section 20 atomizes and ionizes elements in droplets containing the sample solution that is carried with a carrier gas from the sample introduction section 10. The ionization section 20 further includes a torch 22 and an induction coil 24 that is wound around the outside torch 22.

The RF power supply 26 supplies a high frequency power to induction coil 24 to generate a plasma.

The interface section 30 samples the ionized elements within ionization section 20 at an atmospheric pressure and introduces them to the ion lens section 40 under a high vacuum. Interface section 30 includes a sampling cone 32 that controls a direction of a kinetic energy of each ion which is generated by torch 22, and a skimmer cone 34 that passes a portion of the ions which have been passed through sampling cone 32.

The ion lens portion 40 converges the ions that pass through interface portion 30 and guides them to a mass spectrometer portion. Ion lens portion 40 includes an electrode 42 that extracts the ions from an orifice of the skimmer cone, an Einzel lens 44 that converges the ions and an electrode 46 which transports the ions into the mass selection section 50, all of which functions as electrostatic ion lenses.

The mass selection section 50 includes, for example, a quadrupole mass filter 52 comprising four electrode rods 54.

The mass filter drive circuit 56 drives quadrupole mass filter 52.

The ion detection section 60 counts the ions of the mass number (being measured) from mass selection portion 50, and includes, for example, a secondary electron multiplier tube 62.

In FIG. 1, a vacuum exhaust system 70 includes a rotary pump 72 that creates a vacuum within an interface chamber 38 formed by sampling cone 32 and skimmer cone 34; a turbo molecular pump 74 that creates a high vacuum within ion lens chamber 48 of ion lens section 40; a turbo molecular pump 76 that creates a high vacuum within analyzer chamber 58 in which quadrupole mass filter 52 and secondary electron multiplier tube 62 are enclosed; and a rotary pump 78 that creates a low vacuum for turbo molecular pumps 74 and 76. A system controller 80 controls portions of the apparatus such as sample introduction section 10, gas control section 18, RF power supply 26, mass filter drive circuit 56, detection section 60, and vacuum exhaust system 70. A workstation 82 provides instructions to system controller 80 and performs data collection and analysis of the spectroscopic data.

The inductively coupled plasma mass spectroscopic apparatus (as described above) allows a carrier gas to flow into torch 22 where a high frequency electric field is applied to induction coil 24 to create a plasma into which nebulized sample solution 8 is introduced, in order to ionize the elements within sample solution 8. The ions pass through interface section 30 which is comprised of sampling cone 32 and skimmer cone 34, and enter ion lens portion 40. Then, the quadrupole mass filter 52 selects the elements based on their mass and an electron multiplier 62 detects them. The lower limit of detection can be as low as sub ng/L (ppt) for most of elements, thereby an element analysis with very high sensitivity can be achieved.

However, a low efficiency of an ion transmission from ion lens section 40 to mass selection section 50 limits a detection capability of an inductively coupled plasma spectrometer. Such transmission efficiency is one of indexes showing a performance of the ion lens section including an electrostatic ion lens and/or an ion beam guide. It is defined as B/A, where A represents a number of ions which enter the ion lens section and B represents a number of ions which come out of the ion lens section and enter the mass spectrometer section. In particular, a multi-stage arrangement in which a plurality of lenses are arranged in series requires a complex ion lens system and a difficult and complicated alignment.

Another problem is a transmission of undesired particles to a detector, such as vacuum ultraviolet photons generated in a plasma, which cause continuous background to be appeared in a spectrum and thus, lowers S/N ratio or a detection capability of the detector.

Accordingly, a first object of the present invention is to enhance the ion transmission efficiency of the ion lens section including an ion beam guide and to facilitate an adjustment (alignment) of the apparatus.

A second object of the invention is to prevent the light, which repeatedly reflected (multiple reflection) off an inner surface of a multipole ion beam guide, from reaching the ion detector.

A third object of the invention is to provide an improved and easy maintenance for an ion beam guide.

SUMMARY OF THE INVENTION

An inductively coupled plasma mass spectroscopic apparatus includes a sample introduction section for nebulizing a sample solution and introducing nebula of a sample solution into an ionization section, an ionizing section, including a torch, for ionizing elements in the nebula of the sample solution which are carried with a carrier gas from the sample introduction section, an interface section for sampling the ionized elements from the ionization section at an atmospheric pressure and introducing ions of the ionized elements into an ion lens section under a vacuum, an ion lens portion, including an ion beam guide, for converging the ions that pass through the interface section, a mass selection section with a mass filter for separating and filtering the ions which are introduced from the ion lens section based on a measured mass number, and an ion detection section for counting the ions of the measured mass number from the mass selection section. The apparatus further includes a multipole ion beam guide for at least one portion of the ion lens section having four or more electrode rods.

Specifically, when the multipole ion beam guide is divided in a moving direction of the ion beam, it can be optimized by applying a different bias voltage to each of the divided multipole ion beam guide.

Within the divided multipole ion beam guide, the electrode rods of an output side multipole ion beam guide can be arranged so as to tilt or bend with respect to a moving direction of an ion beam in an input side multipole ion beam. Such an arrangement prevents that photons, which are generated by the inductively coupled plasma of the ionizing section, enter the detector section, so that a measurement accuracy can be enhanced.

It is also possible to accurately drive a divided multipole ion beam guide. In particular, the substantially same high frequency voltage is applied to both of the divided multipole ion beam guide while a direct current bias voltage is applied with a positive voltage on the input side multipole ion beam guide and with a negative voltage on the output side multipole ion beam guide.

When an octapole having eight electrode rods is used for a multipole ion beam guide, it can particularly enhance the ion transmission efficiency. Such number of the electrode rods should not be limited to eight: it may be four or more, such as a quadruple (Q-pole) with four rods, a hexapole with six rods, or a dodecapole with twelve rods.

Also, in the case that a high frequency voltage, which is applied to a mass filter, is divided and applied to a multipole ion beam guide, an additional power supply for a beam guide can be eliminated. Accordingly, a power supply can be simple while it can provide optimized high frequency voltages for ions of all masses, in cooperation with the mass filter.

The design of the apparatus can also be simplified. In particular, a high frequency voltage is obtained from a power supply of the mass filter by using capacitors and applied to a multipole ion beam guide with a direct current bias voltage which is added through a resistance.

When a high frequency voltage is obtained from a mass filter power supply and a direct current bias voltage is superimposed on the high frequency voltage by using a transformer with a center tap, a stable bias voltage can be applied to all rods, even for a non-linear load. It can therefore drive an ion beam where a large current flows by an incidence of plasma, e.g. an input side multipole ion beam.

Furthermore, the present invention addresses the second object by constructing a multipole ion beam guide with a black pole of low light reflectance.

A black pole can be easily formed by coating a low reflectance and conductive film on an electrode rod.

A film of low reflectance can also be formed of a black chrome to ensure a formation of the film.

Prior to a coating of a low reflectance film above, at least inner surface of the electrode rods can be delustered by treating a surface of an electrode rod to provide a rough finish which eliminate a luster of the rod surface and thus reduces its reflectance.

Furthermore, the present invention addresses the third object by arranging a given number of an electrode rods which form a multipole ion beam guide removable and/or detachable.

A simple shape of an electrode rod can be utilized where the electrode rod having a circular cross-section and is retained by a rod support member. The rod support member include a circular concave portion in which its upper portion is partially cut away to allow an insertion of a rod.

It is also possible to minimize an electric field disturbance caused by the rod support member by providing a holding portion of an electrode rod which is then retained by a rod support member so that it can be located at a distance from an essential part of the ion beam guide.

When the holding portion of an electrode rod is formed a part of dual rod shape, the electrode rod can be easily manufactured by an extrusion or a drawing. For instance, the electrode rod can have a dual rod shape and a part of which can form a holding portion.

Furthermore, in the case that a cross-section at an ion beam side of the dual rod-shaped electrode rod is made close to a circle as possible while a side surface of a holding portion of the electrode rod and a rod support portion of a rod support member form linear portions, thereby the electrode rod can be securely held with a linear contact of the linear portions.

DESCRIPTION OF THE REFERENCE NUMERALS

Figure 1:
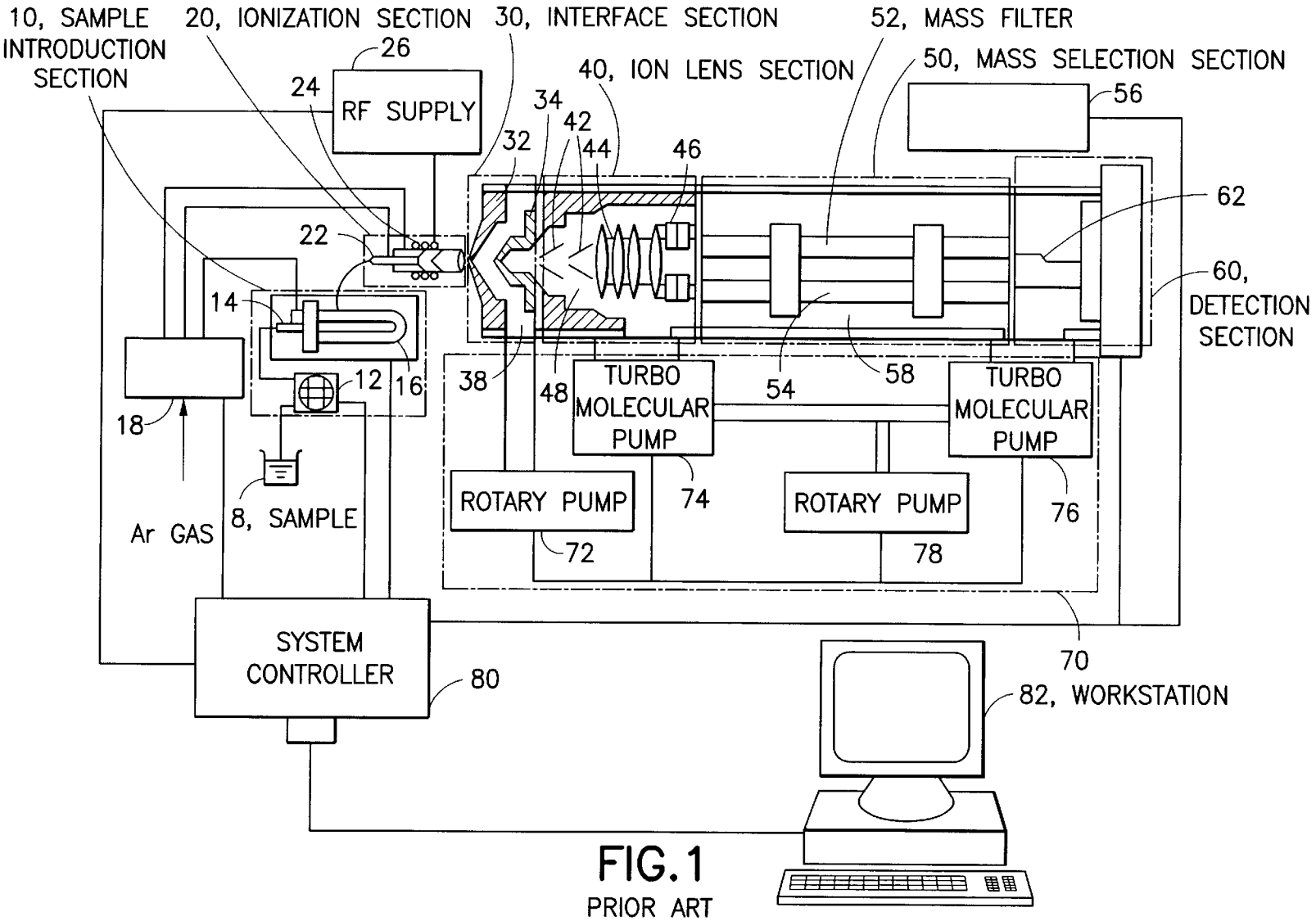
FIG. 1 PRIOR ART
FIG. 1 illustrates a block diagram and a partial cross-section of a conventional inductively coupled plasma mass spectroscopic apparatus.

8: sample solution
10: sample introduction section
20: ionization section
22: torch
26: RF power supply
30: interface section
32: sampling cone
34: skimmer cone
40: ion lens section
42: electrode
44: converging lens
46: ion Lens
50: mass selection section
52: quadrupole mass filter
54: electrode rod
56: mass filter drive circuit
60: detection section
62: secondary electron multiplier tube
70: vacuum exhaust system
72, 78: rotary pump
74, 76: turbo molecular pump
80: system controller
82: workstation
100: octapole ion beam guide
102, 122, 140: electrode rod
102B: black rod
103: gate valve
104: aperture plate
106: center tapped transformer
110: input side octapole ion beam guide
112: output side octapole ion beam guide
112B: black multipole ion beam guide
120: quadrupole ion beam guide
130, 142: rod support frame
130A, 142A: rod support portion
140A: holding portion
140D: linear portion
142A: rod support portion

DETAILED DESCRIPTION OF THE INVENTION

Figure 2:
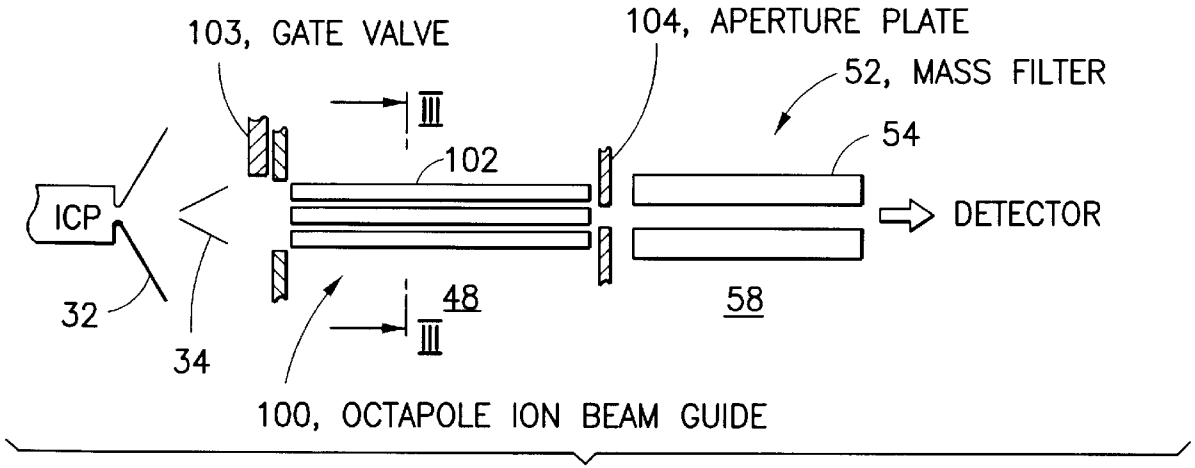
FIG. 2 illustrates a side view of a design of the area around an ion lens portion of a first embodiment of the present invention.
Figure 3:
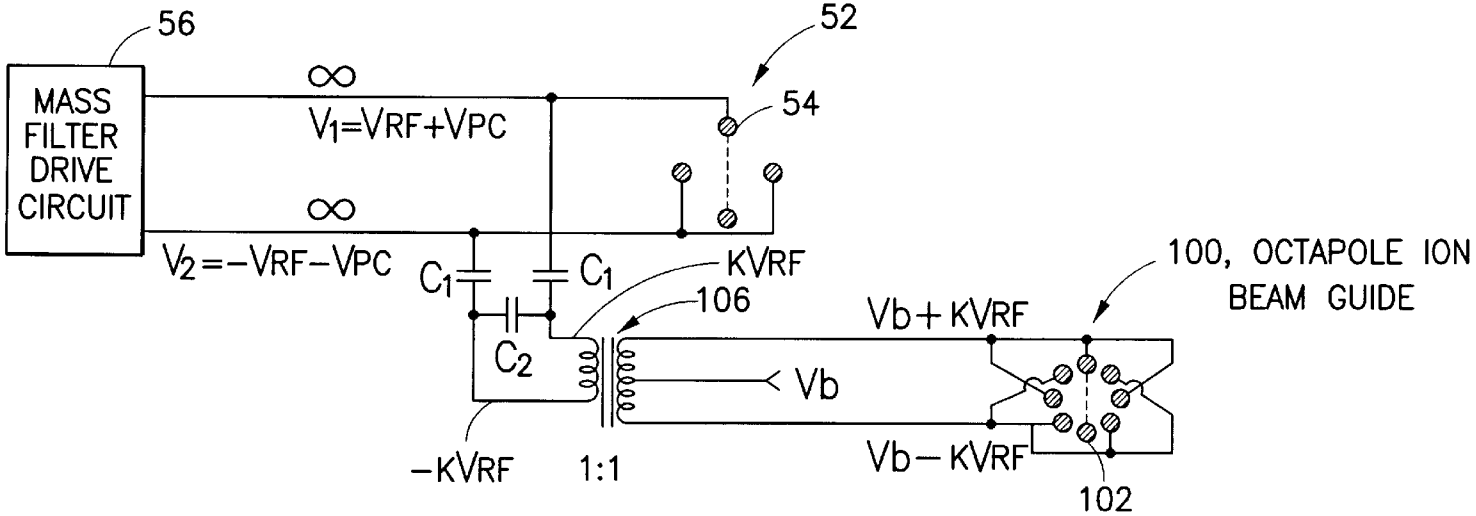
FIG. 3 illustrates a circuit diagram that includes a cross-section along the III—III line of FIG. 2, showing a design of a circuit that applies a voltage to an octapole ion beam guide employed in the first embodiment of the present invention.

FIG. 2 and 3 illustrate a first embodiment of an inductively coupled plasma mass spectroscopic apparatus in accordance with the present invention. The first embodiment is provided with an ion lens section 40 having an octapole ion beam guide 100 with eight electrode rods 102 which are arranged symmetrically around a center line.

Referring to FIG. 2, the inductively coupled plasma mass spectroscopic apparatus includes an inductively coupled plasma (ICP), and a gate valve 103 for retaining a vacuum within an ion lens chamber 48 enclosing an octapole ion beam guide 100 as well as within an analyzer chamber 58 in which a mass filter 58 is located when an operation of the apparatus is stopped, and an aperture plate 104 is placed between ion lens chamber 48 and analyzer chamber 58.

In the first embodiment of the present invention, when the nebulized sample solution (not shown) is introduced into the inductively coupled plasma (ICP), elements in the sample solution are ionized. These ions then pass through an interface section, which includes a sampling cone 32 and a skimmer cone 34, and enter the octapole ion beam guide 100. Particles which have entered the octapole ion beam guide 100 are not just ions (charged particles) of the elements to be analyzed, but also include electrons and neutrals such as Argon (Ar) as well as ions of no interest. However, the ions fly closely along a central axis of the octapole ion beam guide 100 due to a high frequency electric field of the octapole, while electrons and neutrals tend to diverge or diffuse. Therefore the ions of elements to be analyzed and the ions of no interest can then pass through aperture plate 104 and enter the mass selection section. Subsequently, the ions having the desired mass number (among all the ions) pass through mass filter 52 to be analyzed and are counted by a detector.

Referring to FIG. 3, a voltage to be applied to octapole ion beam guide 100 will be explained. Voltages V1 and V2, which are applied to electrode rods 54 of a quadrupole mass filter 52 by a mass filter drive circuit 56, are divided with capacitors C1 and C2. The divided voltages are then applied to a center tapped transformer 106 while a direct current bias voltage Vb is also applied to the center tap of the transformer. Voltages are then applied to electrode rod 102 of octapole ion beam guide 100. Note that the same voltages can be applied to the electrodes which are symmetrical with respect to the center line for electrode rods 54 of quadrupole mass filter 52 and electrode rods 102 of octapole ion beam guide 100.

If the voltages V1 and V2 that are applied to each of electrode rods 54 of the mass filter 52 are given by the equations:

$$V1=V_{RF}+V_{DC} \quad (1)$$

$$V2=V_{RF}-V_{DC} \quad (2)$$

where:

$V_{RF}$ is a high frequency component; and $V_{DC}$ is a direct current component, then the voltages that are applied to each of electrode rods 102 of octapole ion beam guide 100 are $kV_{RF}$ and $-kV_{RF}$ in addition to the direct current bias voltage Vb. These voltages $kV_{RF}$ and $-kV_{RF}$ can be controlled by the values of capacitors C1 and C2. For example, for k=0.08, the voltages $kV_{RF}$ and $-kV_{RF}$ to be applied to each of electrode rods 102 of octapole ion beam guide 100 can be set as 8% of the high frequency component $V_{RF}$ and $-V_{RF}$ of V1 and V2.

Figure 4:
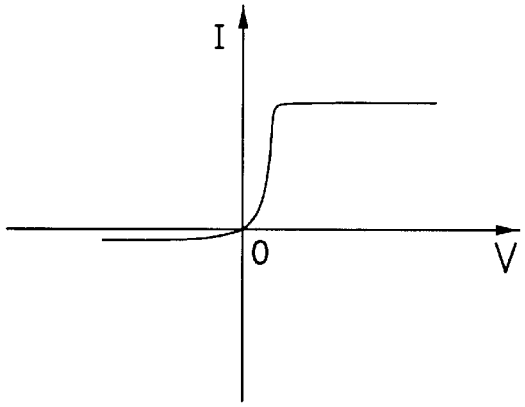
FIG. 4 illustrates a graph of the current-voltage characteristics of the octapole ion beam guide at the side of a skimmer cone.

In this embodiment, center tapped transformer 106 is utilized to apply a direct current bias voltage in addition to the voltages to be applied to electrode rods 102 of octapole ion beam guide 100. Accordingly, the bias voltage can be applied to rods even if the octapole has a nonlinear load. For example, FIG. 4 illustrates the current-voltage characteristics of the octapole ion beam guide located on the side of skimmer cone 34 where the plasma enters. Current does not rarely flow when a negative voltage is applied, and a current largely flow when a positive voltage is applied.

Figure 5:
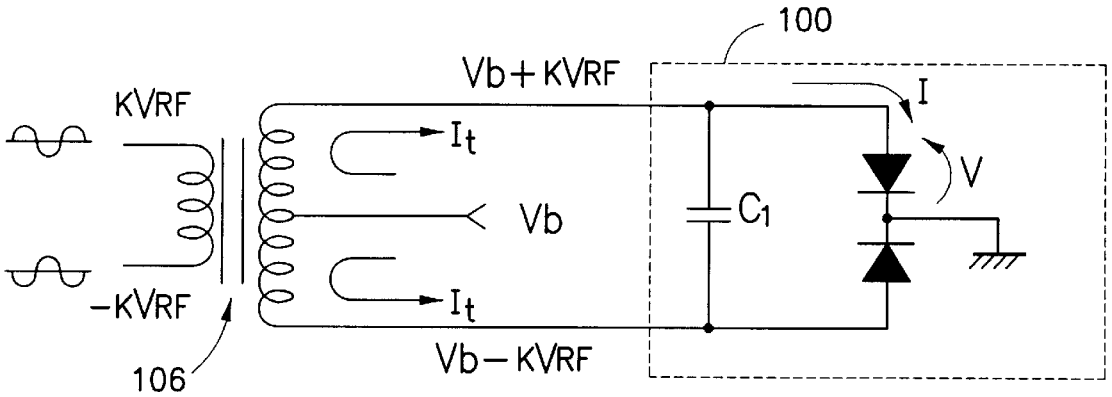
FIG. 5 illustrates an equivalent circuit for the octapole ion beam guide.

As will be shown later in FIG. 7, if a direct current bias voltage Vb is applied through two resistors R to this type of an ion beam guide, the current would only flow through one of the resistors. In response to a change of a sign of the applied voltage, the current is switched to flow through a different resistor. The bias voltage that is applied to electrode rods 102 decreases by the amount that a voltage drop at resistors R. A different bias voltage is thus applied to each set of four rods. As shown in FIG. 3, if center tapped transformer 106 is used without a resistor, it is possible to apply a desired bias voltage to all electrode rods, regardless of a size of the current. FIG. 5 shows an equivalent circuit where the octapole ion beam guide is actuated.

Figure 6:
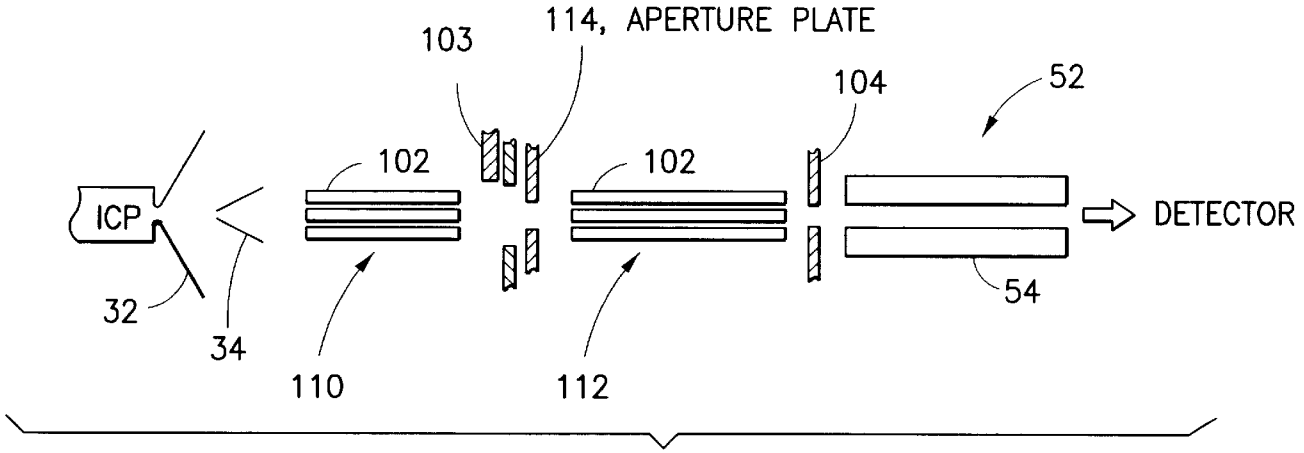
FIG. 6 illustrates a side view of a design of the ion lens portion in a second embodiment of the present invention.

Referring to FIG. 6, a second embodiment of the present invention divides octapole ion beam guide 100 in an ion flight direction (i.e. a moving direction of an ion beam), so that two octapole ion beam guides are provided: 110 is an input side octapole ion beam guide and 112 is an output side octapole ion beam guide. An aperture plate 114 is position between octapole ion beam guides 110 and 112 in order to maintain a high ion transmission efficiency.

In the second embodiment, when the nebulized sample solution (not shown) is introduced into the inductively coupled plasma (ICP), elements in sample solution are ionized. These ions then pass through the interface section which include sampling cone 32 and skimmer cone 34, and enter the input side octapole ion beam guide 110. These ions fly closely to the central axis of input side octapole ion beam guide 110 due to a high frequency electric field generated by the octapole, while other particles such as electrons and neutrals diverge or diffuse. These ions then pass through aperture plate 114 and enter output side octapole ion beam guide 112 where they fly closely to the center axis (i.e., same as with input side octapole ion beam guide 110) and are introduced into the mass selection section. The ions having a desired mass number among all the ions of the sample solution can only pass through mass filter 52 and are then detected by a detector.

Similar to the first embodiment of the invention, the voltages for input side octapole ion beam guide 110 can be provided by using a circuit as shown in FIG. 3.

Since output side octapole ion beam guide 112 is apart from skimmer cone 34 (which is different from input octapole ion beam guide 110), a use of a center tapped transfer may not be necessary. Instead, a direct current bias voltage can be superimposed by resistors R's on the voltages ($kV_{RF}$, $-kV_{RF}$) derived from mass filter drive circuit 58 by capacitors C1, C2 as shown in FIG. 7.

Figure 7:
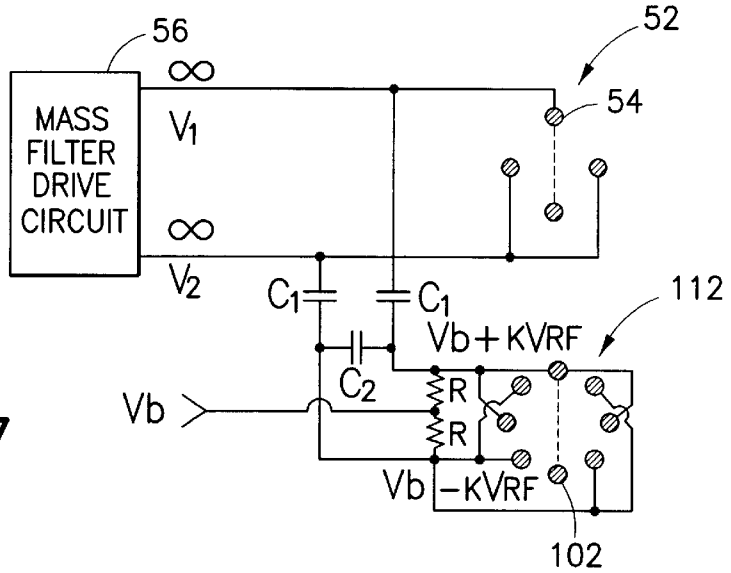
FIG. 7 illustrates a circuit diagram of a design of a circuit that applies a voltage to the output side octapole ion beam guide utilized in a second embodiment of the present invention.

It should be noted that the circuit shown in FIG. 7 can provide an improved ion transmission efficiency when a voltage that is 8% of that on the mass filter is applied to the octapole ion beam guide for the range from about 5 atomic mass units (amu) to 250 amu.

Figure 8:
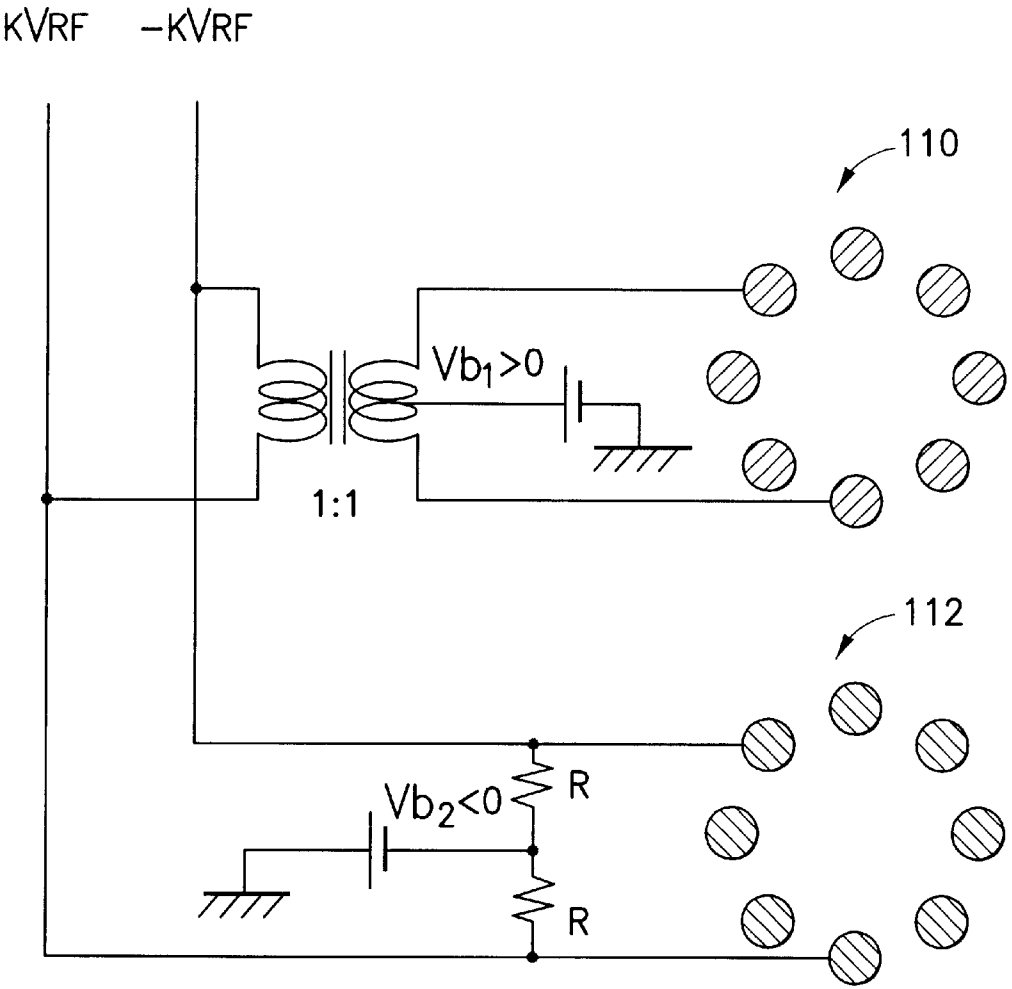
FIG. 8 illustrates a circuit diagram of a design of a circuit that applies different direct current bias voltages to an input side octapole ion beam guide and the output side octapole ion beam guide.

In the second embodiment, the same high frequency voltage is applied to both input side octapole ion beam guide 110 and output side octapole ion beam guide 112. However, the direct current bias voltage can be applied with a positive voltage Vb1 to input side octapole ion beam guide 110 and a negative voltage Vb2 to output side octapole ion beam guide 112, as shown in FIG. 8. Our experimental result also shows that a good transmission efficiency can be achieved by providing different polarities of the bias voltages to be applied at the input side octapole ion beam guide and the output side octapole ion beam guide.

Figure 9:
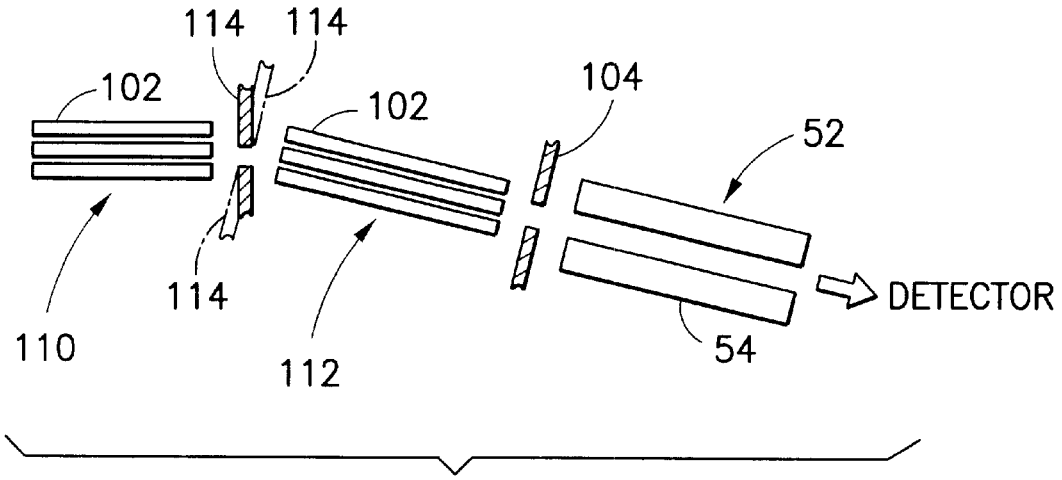
FIG. 9 illustrates a side view of a modified second embodiment of the present invention.
Figure 10:
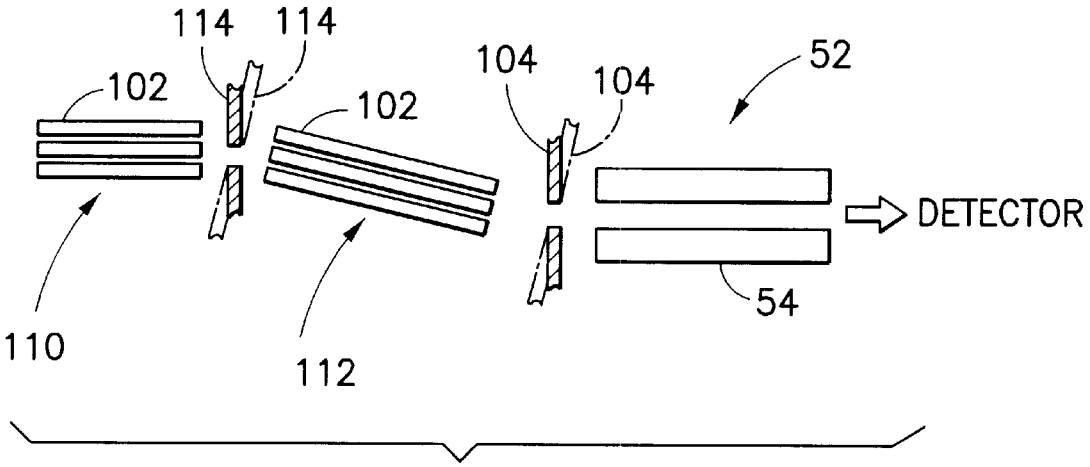
FIG. 10 illustrates a side view that shows another modified example in the second embodiment.
Figure 11:
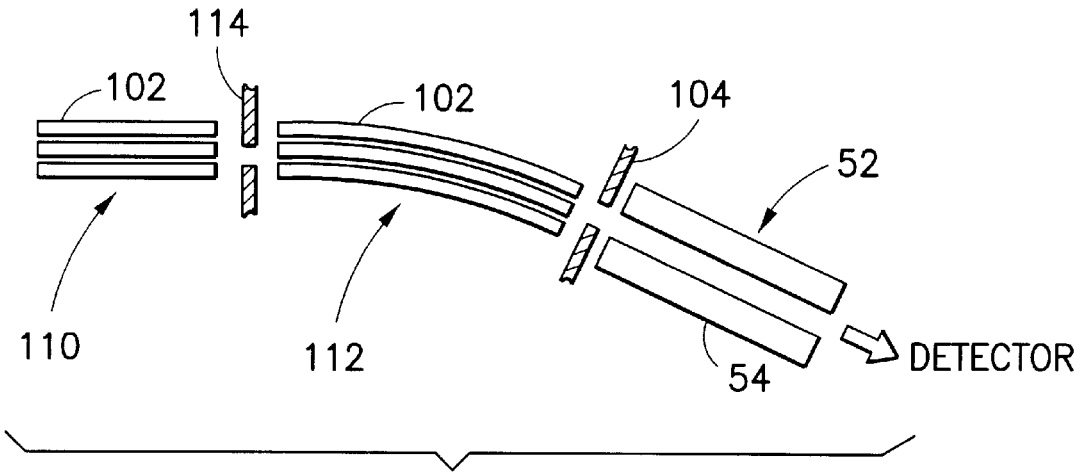
FIG. 11 illustrates a side view that shows yet another modified example in the second embodiment.
Figure 12:
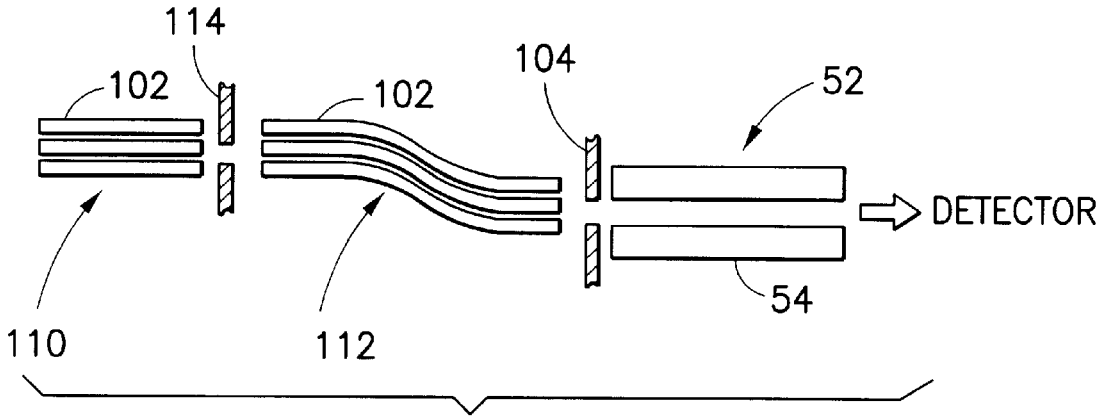
FIG. 12 illustrates a side view that shows yet another modified example in the second embodiment.

As shown in FIG. 9 and 10, the electrode rods of output side octapole ion beam guide 112 can be tilted with respect to a moving direction of an ion beam, or bent as shown in FIG. 11 and 12, so as to prevent an direct entrance of photons of light from an inductively coupled plasma into mass filter 52. Consequently, the noise from direct light can be reduced in the range of $1/10^4$ and $1/10^5$, and it can highly enhance the S/N ratio and the measurement accuracy. Aperture plate 104 and 114 can be positioned either the direction shown with a solid line or shown with a broken line in FIG. 9 and 10.

In the arrangement shown in FIG. 9 and 10, the tilted angle of electrode rods 102 and 54 with respect to a moving direction of the ion beam may be determined with a diameter of apertures in aperture plates 104, 114 and a length of a beam guide. When this angle becomes too large, the ions increasingly tend to fly off the beam of ions and collide against the electrode rods. It is thus preferable to minimize the tilted angle while a direct entrance of light into a detector can be prevented.

In the arrangement shown in FIG. 11 and 12, a smaller curvature for bent electrode rods 102 may be preferred with respect to an aspect of the ion transmission efficiency. An entire length of electrode rods 102 may be preferably bent in order to minimize a value of its curvature. A cross-section of an electrode rod may have at least a portion of a liner section for the purpose of an assembly and arrangement of a ion beam guide.

It should be noted that the direction in which the electrode rods 102 are tilted or bent is optional: it can be bent or tilted upward or downward from an central axis of an ion beam guide.

In FIG. 9 and 10, conventional linear electrode rods may be used.

In the arrangement shown in FIG. 9 and 11, the ion beam is bent only once during passing through the electrode rods of input side ion beam guide, thereby a large number of ions can reach mass filter 52.

In the arrangement shown in FIG. 10 and 12, the electrode rods of input octapole ion beam guide 110 and mass filter 52 locate in parallel, so that a total size of the apparatus can be smaller than with the arrangement shown in FIG. 9 and 11.

In the arrangement shown in FIG. 11 and 12, the ion beam can be bent gradually so that the loss of ions at input and output portion of electrodes can be minimized.

Figure 13:
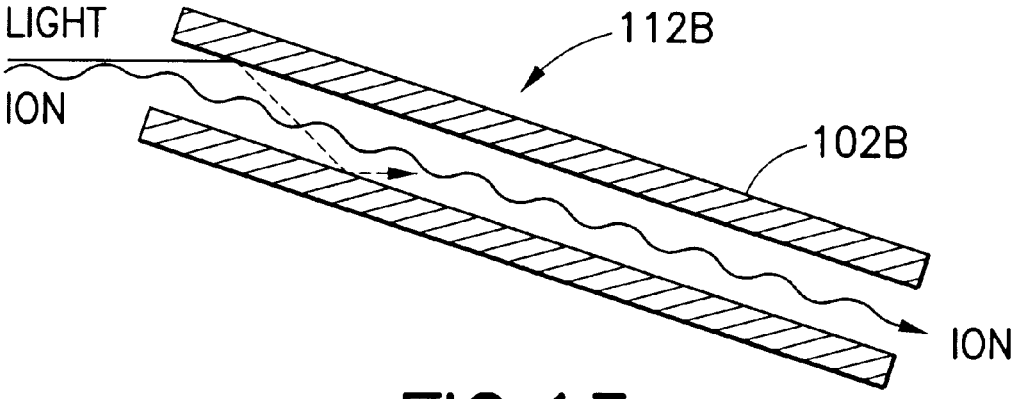
FIG. 13 illustrates a side view that shows the ion beam guide used in a third embodiment of the present invention.

FIG. 13 illustrates an ion beam guide utilized in a third embodiment of the present invention. The third embodiment uses a black multipole ion beam guide 112B in which the electrode rods are black rods 102B. Black rods 102B may be formed by using a shot blast to roughen and remove the luster from the inner and/or the outer surface of a stainless steel rod. The rod is then coated with a black chrome with a thickness of 1 $\mu$m, thereby forming a coating conductive film of low reflectance (it can be referred to a black coating).

In accordance with the third embodiment, the ions are allowed to reach the ion detection section through a multiple reflection at the inner surface of the electrode rods, which are tilted or bent with respect to a moving direction of ion beam. Accordingly, in comparison with the electrode rod of a pure stainless rod or the electrode rod where its surface is gold plated for soldering with a holding frame, a light reflection which would cause a background noise can be greatly reduced (a degree of such noise reduction may be depended on a tilted angle and/or a length of rods, however, the experimental result conducted by our inventors of this applications show to the extent of 1/20), and the design of apparatus (ICP-MS) can be simplified by eliminating a light seal plate (a photon stopper) and an omega (Q) lens for bending an ion trajectory.

Particularly, in the case that the surfaces of the electrode rods are roughened and delustered prior to a black coating process, greater effect of preventing a reflectance can be accomplished.

Such black coating can also be an alumite process (if the electrode rods are made from aluminum), a zinc black coating or a conducting spray (when it is not used in a vacuum) in addition to the black chrome plating.

Figure 14:
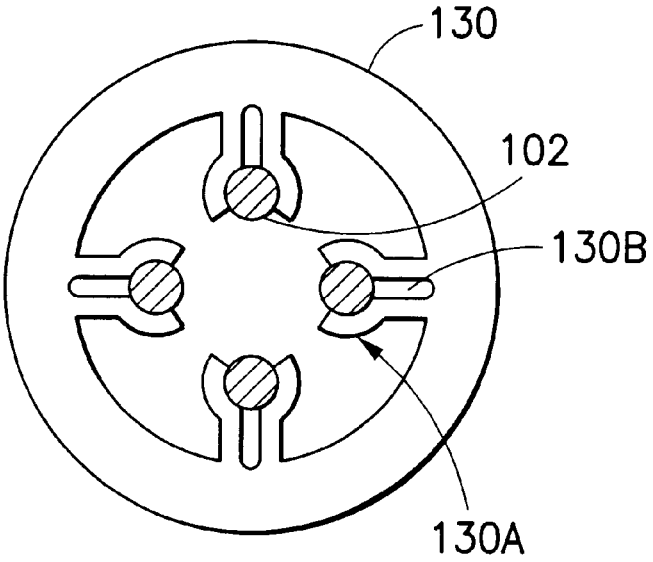
FIG. 14 illustrates a front view that shows how the electrode rods are held by a rod support structure used in a fourth embodiment of the present invention.

As a fourth embodiment of the present invention, FIG. 14 illustrates a support method for the electrode rods. In the fourth embodiment, a plurality of rod support members having a support portion 130A are mounted on a rod support frame 130. Rod support member may also includes a notched base portion which holds support portion 130A. Support portion 130A forms a notched circular shape and an upper part of which is cut away so that the rod can be retained at the side of circular concave support portion 130A. A notched portion may be continuous to a notch of the base portion. Support portion 130A is thus concave in which an electrode rod is inserted. Electrode rods 102 or 102B can be pinched and held by rod support member.

Rod support frame 130 may be formed of, for example, an elastic stainless steel SUS304-CSP, which is generally used for a spring. The inner diameter of rod support portion 130A is slightly smaller than the outer diameters of electrode rods 102 or 102B. 130B is formed to facilitate an insertion of a rod.

Figure 15:
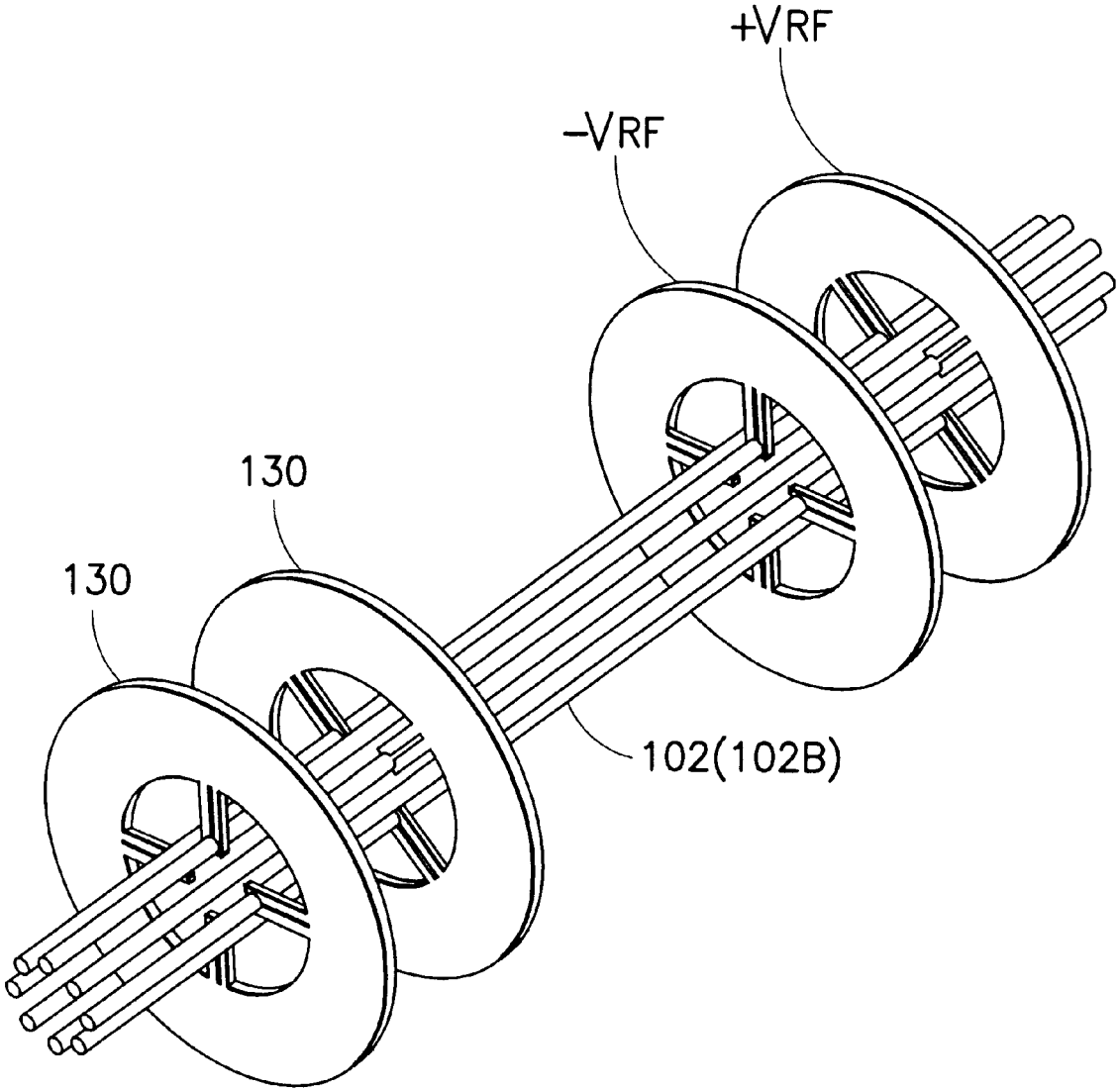
FIG. 15 illustrates a side view of the fourth embodiment of the present invention.

FIG. 15 illustrates an assembled octapole ion beam guide of the fourth embodiment of the present invention. In this case, two pairs of rod support frames 130 with four support members are provided near the ends of the electrode rods. Each pair of these rod support frames are offset by 45 degrees so that two different electric potentials ($+V_{RF}$ and $-V_{RF}$ in FIG. 15) can be provided to the two of adjacent electrode rods.

In the fourth embodiment, electrode rods 102 are not fixed to a rod support structure by means of soldering or welding so that they are detachable and removable from the support structure. Accordingly, a smeared electrode rod due to a long term use can be easily exchanged (easy maintenance).

In the fourth embodiment, the electrode rods having a simple shape of a circular cross-section can be utilized.

Figure 16:
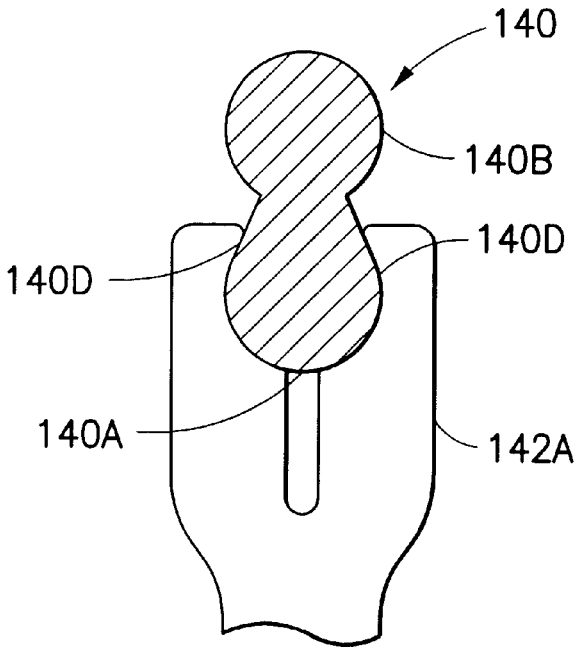
FIG. 16 illustrates a cross-section of a fifth embodiment of the present invention.
Figure 17:
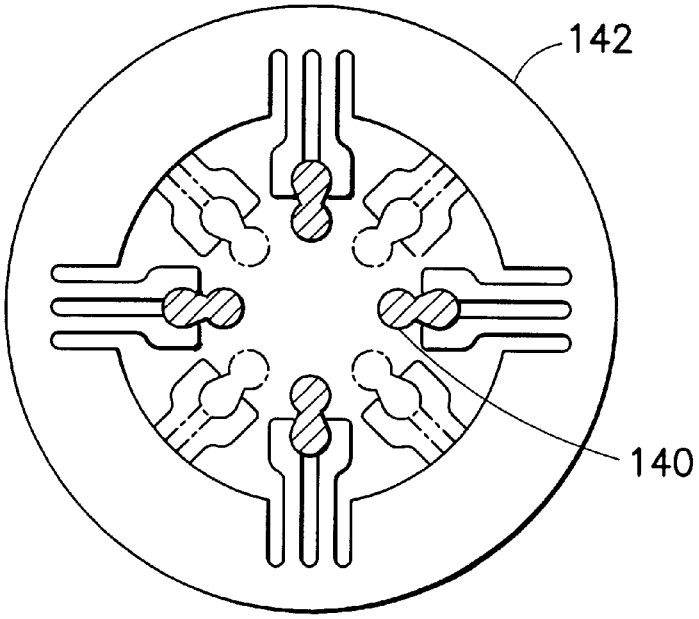
FIG. 17 illustrates a front view that shows how the electrode rods are held.

FIG. 16 and 17 illustrate electrode rods and their support method for a fifth embodiment of the present invention. In the fifth embodiment as shown in FIG. 16, an electrode rods 140 has a dual rod shape, in which two rods are partially joined as shown in these drawings and one of which functions as a holding portion 140A. Holding portion 140A is pinched and held by a rod holding portion 142A of a rod support member which incorporated with a rod support frame 142, as shown in FIG. 16 and 17.

In the fifth embodiment, rod support portion 142A can be located apart from an essential part of the ion beam guide so that a rod support portion 142A would not extend above holding portion 140A of rods, and thus 140B, which positions close to the ion beam, would not be overlapped with the support member. Accordingly, an electric filed distribution generated within the ion beam guide would not affect by any portion of rod support member, which may be superfluous structure to a formation of an electric field.

In the fifth embodiment, the cross-sections of ion beam portion 140B of electrode rod 140 with a dual rod shape should be made as close to a circle as possible while holding portion 140A of electrode rod 140 as well as rod support portion 142A include a linear portion 140D at their side surfaces. Thereby, electrode rod 140 can be securely held by a linear contact between holding portion 140A of electrode rod 140 and rod support portion 142A of rod support frame 142.

Since electrode rod 140 also has the same cross-section along its lengths, it can be manufactured by a drawing process or an extrusion process.

It should be understood that a cross-section of ion beam side portion 140B of electrode rod 140 should not be limited to a circular shape. Different cross-section may also be utilized such as a portion of a hyperbola. Likewise, the cross-sections of holding portion 140A of electrode rod 140 should not be limited to a circle, it can be formed of a rhombus or a triangle. Furthermore, it should not be necessary to form a holding portion extending continuously over an entire length of the rod. Such holding portion of rods may be provided at a part of a length of rods in a discontinuous manner.

Figure 18:
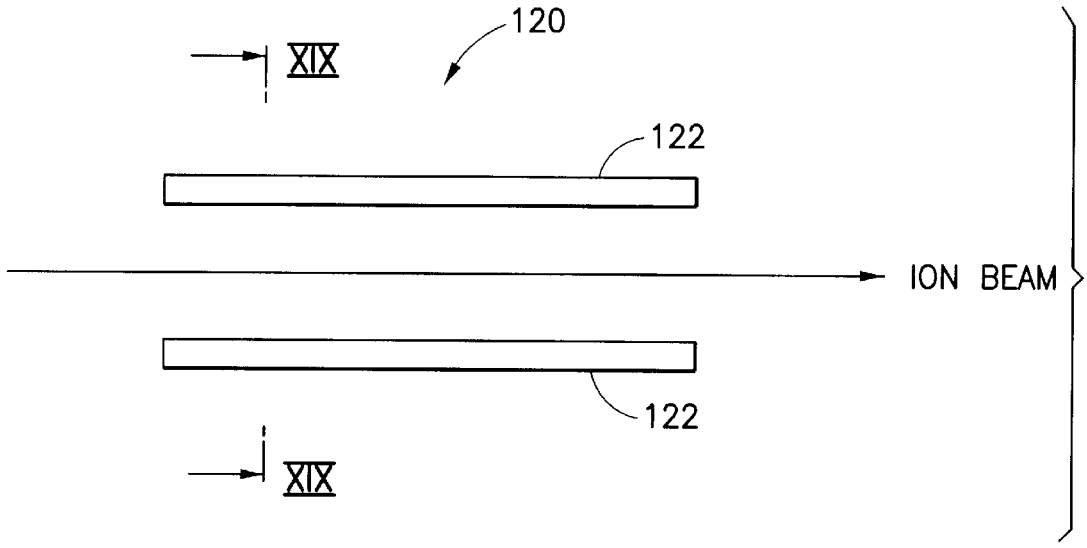
FIG. 18 illustrates a side view that shows a modified example of an ion beam guide.
Figure 19:
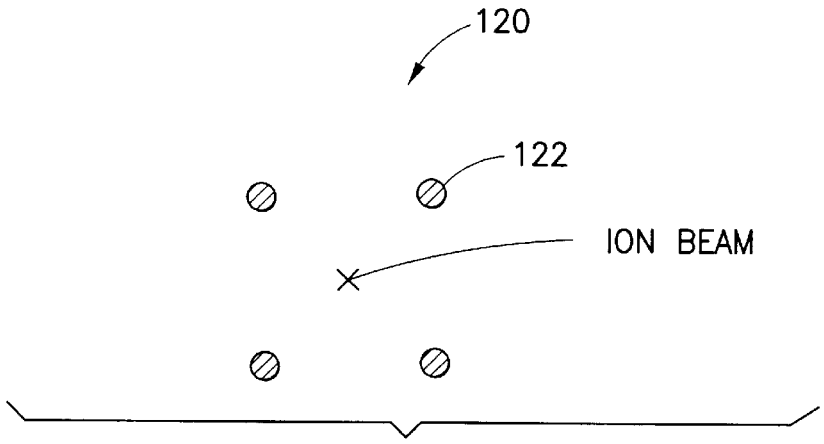
FIG. 19 illustrates a cross-sectional view along line XIX of FIG. 18.

In the fifth embodiment, an octapole ion beam having eight electrode rods is used for both input side octapole ion beam guide 110 and output side octapole ion beam guide 112. However, as shown in FIG. 18 (a side view) and FIG. 19 (a cross-sectional view), an optimal number or a total number of the ion beam guides may be quadrupole (Q-poles) ion beam guide 120 having four electrode rods 122. Other multipole ion beam guide having different number of rods, such as a hexapole with six rods or a dodecapole with twelve rods.

In summary, the present invention improves the ion transmission efficiency from the ion lens portion to the mass selection portion, while simplifying the adjustment process and reducing the background noise. The invention makes at least one portion of ion lens portion 40 a multipole ion beam guide (100, 110, 112, 112B, 120) with four or more rods.

We claim:

1. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods;

a mass selection section, containing a mass filter, for filtering ions based on a mass number being measured from ions from said ion lens section;

an ion detection section for counting said ions which passed through said mass selection section; and wherein said multipole ion beam guide is comprised of a first ion beam guide and a second ion beam guide positioned along a moving direction of an ion beam, said first multipole ion beam guide positioned to receive said ions from said interface section and said second multipole ion beam guide positioned to receive the ions passed through said first multipole ion beam guide and to direct the ions to said mass selection section, and wherein approximately equal high frequency voltages are applied to said first multipole ion beam guide and second multipole ion beam guide and a positive direct current bias voltage is applied to said first multipole ion beam guide and a negative direct current bias voltage is applied to said second multipole ion beam guide.

2. An apparatus as recited in claim 1, wherein said multipole ion beam guide comprises a quadrupole with four electrode rods.

3. An apparatus as recited in claim 1, wherein said multipole ion beam guide comprises an octapole with eight electrode rods.

4. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods;

a mass selection section, containing a mass filter, for filtering ions based on a mass number being measured from ions from said ion lens section;

an ion detection section for counting said ions which passed through said mass selection section; and wherein an applied high frequency voltage applied to said mass filter is further applied to said multipole ion beam guide.

5. An apparatus as recited in claim 4, wherein said apparatus includes a mass filter drive circuit which applies a voltage to said mass filter and said multipole ion beam guide.

6. An apparatus as recited in claim 4, wherein said applied high frequency voltage is derived by means of a capacitor and is applied to said multipole ion beam guide and a direct current bias voltage is provided to said multipole ion beam guide through a resistor means.

7. An apparatus as recited in claim 4, wherein said applied high frequency voltage is derived by means of a capacitor and a direct current bias voltage is provided to said multipole ion beam through a center tapped transformer.

8. An apparatus as recited in claim 4, wherein a direct current bias voltage is provided to said first multipole ion beam through a center tapped transformer and a direct current bias voltage is provided to said second multipole ion beam through a resistor means; and wherein said multipole ion beam guide is comprised of a first ion beam guide and a second ion beam guide positioned along a moving direction of an ion beam, said first multipole ion beam guide positioned to receive said ions from said interface section and said second multipole ion beam guide positioned to receive the ions passed through said first multipole ion beam guide and to direct the ions to said mass selection section.

9. An apparatus as recited in claim 4, wherein said multipole ion beam guide comprises a quadrupole with four electrode rods.

10. An apparatus as recited in claim 4, wherein said multipole ion beam guide comprises an octapole with eight electrode rods.

11. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods, said multipole ion beam guide comprising black poles having a low reflectance for light.;

a mass selection section, containing a mass filter, for filtering ions based on a mass number being measured from ions from said ion lens section;

an ion detection section for counting said ions which passed through said mass selection section.

12. An apparatus as recited in claim 11, wherein said black poles are formed by coating a conducting film of low reflectance at least on the inner surface of said black poles.

13. An apparatus as recited in claim 12, wherein said film of low reflectance is a black chrome.

14. An apparatus as recited in claim 12, wherein at least inner surface of said electrode rods is delustered.

15. An apparatus as recited in claim 11, wherein said multipole ion beam guide comprises a quadrupole with four electrode rods.

16. An apparatus as recited in claim 11, wherein said multipole ion beam guide comprises an octapole with eight electrode rods.

17. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods, said electrode rods having a circular cross-section, and held by a rod support structure including (i) a notched circular portion in which an upper portion is cut away to permit an insertion of said electrode rods and (ii) a base portion which engages with said notched support portion of said support structure, and wherein a notch provides a spring force to secure said electrode rods disposed on said notched circular portion;

a mass selection section, containing a mass filter, for filtering ions based on a mass number being measured from ions from said ion lens section; and an ion detection section for counting said ions which passed through said mass selection section.

18. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods;

a mass selection section, containing a mass filter, for filtering ions based on a mass number being measured from ions from said ion lens section;

an ion detection section for counting said ions which passed through said mass selection section; and wherein said multipole ion beam guide is tilted with respect to a movement direction of an ion beam to thereby reduce direct entrance of photons of light into said mass selection section.

19. An apparatus as recited in claim 18, wherein said multipole ion beam guide is bent with respect to a movement direction of the ion beam.

20. An apparatus as recited in claim 19, wherein said multipole ion beam guide comprises an octapole with eight electrode rods.

21. An apparatus as recited in claim 18, wherein said multipole ion beam guide comprises a quadrupole with four electrode rods.

22. An inductively coupled plasma mass spectroscopic apparatus comprising:

a sample introduction section for nebulizing a sample solution;

an ionization section, including a torch, for ionizing elements in said sample solution that are carried with a carrier gas from said sample introduction section;

an interface section for sampling said ionized elements and directing said ionized elements into an ion lens section under a vacuum;

said ion lens section, including an ion beam guide, for converging ions of said elements that pass through said interface section, wherein at least one part of said ion lens section is a multipole ion beam guide having at least four electrode rods;

a mass selection section, containing a mass filter, for filtering ions based on a mass number being measured from ions from said ion lens section;

an ion detection section for counting said ions which passed through said mass selection section; and wherein said multipole ion beam guide is comprised of a first ion beam guide and a second ion beam guide positioned along a moving direction of an ion beam, said first multipole ion beam guide positioned to receive said ions from said interface section and said second multipole ion beam guide positioned to receive the ions passed through said first multipole ion beam guide and to direct the ions to said mass selection section, and wherein said second multipole ion beam guide is tilted with respect to a movement direction of an ion beam.

23. An apparatus as recited in claim 22, wherein said second multipole ion beam guide is bent with respect to a movement direction of the ion beam.

* * * * *